US008981245B2

(12) United States Patent
Dinh et al.

(10) Patent No.: US 8,981,245 B2
(45) Date of Patent: Mar. 17, 2015

(54) MODULAR MOLDED INTERCONNECT DEVICES

(76) Inventors: Richard Hung Dinh, Santa Clara, CA (US); Shayan Malek, San Jose, CA (US); Michael Benjamin Wittenberg, Sunnyvale, CA (US)

( * ) Notice: Subject to any disclaimer, the term of this patent is extended or adjusted under 35 U.S.C. 154(b) by 46 days.

(21) Appl. No.: 13/603,342

(22) Filed: Sep. 4, 2012

(65) Prior Publication Data

US 2013/0327621 A1 Dec. 12, 2013

Related U.S. Application Data

(60) Provisional application No. 61/657,658, filed on Jun. 8, 2012.

(51) Int. Cl.
*H01H 1/20* (2006.01)
*H01H 13/52* (2006.01)

(52) U.S. Cl.
CPC ..... *H01H 1/20* (2013.01); *H01H 2205/002* (2013.01); *H01H 13/52* (2013.01)
USPC ..... 200/243; 200/341

(58) Field of Classification Search
CPC .... H01H 1/20; H01H 13/52; H01H 2205/002
USPC ..... 200/341, 338, 556, 519, 243
See application file for complete search history.

(56) References Cited

U.S. PATENT DOCUMENTS

| | | | | |
|---|---|---|---|---|
| 5,746,307 | A * | 5/1998 | Joss et al. | 200/303 |
| 6,062,914 | A | 5/2000 | Fasano | |
| 6,765,158 | B1 * | 7/2004 | Morrison et al. | 200/5 R |
| 6,784,384 | B2 * | 8/2004 | Park et al. | 200/11 R |
| 7,517,231 | B2 | 4/2009 | Hiew et al. | |
| 7,518,070 | B2 * | 4/2009 | Garcia-Briz | 200/6 A |
| 7,576,291 | B2 * | 8/2009 | Tseng et al. | 200/296 |
| 8,263,887 | B2 * | 9/2012 | Chen et al. | 200/310 |
| 8,493,742 | B2 * | 7/2013 | Li et al. | 361/752 |
| 8,604,372 | B2 * | 12/2013 | Yang et al. | 200/341 |
| 2008/0185282 | A1 | 8/2008 | Garcia-Briz | |
| 2009/0163045 | A1 | 6/2009 | Peloza et al. | |
| 2011/0014800 | A1 | 1/2011 | Cheng et al. | |

* cited by examiner

*Primary Examiner* — Felix O Figueroa
(74) *Attorney, Agent, or Firm* — Womble Carlyle Sandridge & Rice LLP

(57) ABSTRACT

A switching subassembly includes a modular molded interconnect bracket and a switching device arranged on the modular molded interconnect bracket. The modular molded interconnect includes at least one electronic circuit trace arranged thereon configured to interconnect a portion of a flexible printed circuit board and to support a portion of the flexible printed circuit board. The switching device is configured to contact portions of the at least one electronic circuit trace.

21 Claims, 6 Drawing Sheets

MODULAR MOLDED INTERCONNECT DEVICES

CROSS-REFERENCE TO RELATED APPLICATIONS

This application claims priority under 35 U.S.C. 119(e) to U.S. Provisional Patent Application No. 61/657,658, filed Jun. 8, 2012 and entitled "Modular Molded Interconnect Devices" by Dinh et al., which is incorporated by reference in their entirety for all purposes.

FIELD OF THE DESCRIBED EMBODIMENTS

The described embodiments relate generally to interconnect devices, and more particularly, embodiments of the present invention relate to modular molded interconnect devices.

BACKGROUND

An interconnect device is an apparatus configured to allow connectivity between electrical devices or portions of a circuit. A molded interconnect device (MID) is an injection-molded thermoplastic part with integrated electronic circuit traces to allow for this connectivity. Generally, thermoplastics may be used to cast and mold a plurality of MIDs for use in the manufacture of a plurality of different end-user devices.

As is generally appreciated, electronic circuit traces may become worn, separable from underlying substrates (i.e., the MID itself), or may malfunction entirely during regular use. Depending upon any end-user device's structural configuration, it may become exceedingly difficult to service the end-user device absent damage to other portions of the device or removal and replacement of entire integrated portions of the device.

Therefore, what is needed are modular molded interconnect devices which overcome these and other drawbacks.

SUMMARY OF THE DESCRIBED EMBODIMENTS

This paper describes various embodiments that relate to molded interconnect devices. These devices may include a main body molded from a moldable material with at least one conductive path disposed on a surface thereof.

According to an embodiment of the present invention, a switching subassembly includes a modular molded interconnect bracket and a switching device arranged on the modular molded interconnect bracket. The modular molded interconnect includes at least one electronic circuit trace arranged thereon configured to interconnect a portion of a flexible printed circuit board and to support a portion of the flexible printed circuit board. The switching device is configured to contact portions of the at least one electronic circuit trace.

According to another embodiment of the present invention, a switching assembly includes a flexible printed circuit board, a modular molded interconnect bracket arranged to support at least a portion of the flexible printed circuit board, and a switching device arranged on the modular molded interconnect bracket. The flexible printed circuit board has at least one printed electronic circuit trace. The modular molded interconnect bracket has at least one electronic circuit trace arranged thereon configured to interconnect a portion of the printed electronic circuit trace. The switching device is configured to contact portions of the at least one electronic circuit trace.

According to another embodiment of the invention, a switching assembly includes a modular molded interconnect bracket having at least one electronic circuit trace arranged thereon configured to interconnect a portion of a flexible printed circuit board and to support a portion of the flexible printed circuit board, the modular molded interconnect bracket being defined by a molding process and a laser-direct structuring process for forming the at least one electronic circuit trace. The switching assembly further includes a switching device arranged on the modular molded interconnect bracket configured to contact portions of the at least one electronic circuit trace. The switching assembly further includes a cosmetic button cover engaged with the compliance switching device. The switching assembly further includes a housing engaged with the cosmetic button cover. The switching assembly further includes at least one fastener arranged to support the modular molded interconnect bracket against the flexible printed circuit board and the flexible printed circuit board against the housing.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

Various aspects of this disclosure may be better understood upon reading the following detailed description and upon reference to the drawings in which.

DETAILED DESCRIPTION OF SELECTED EMBODIMENTS

Figure 1:
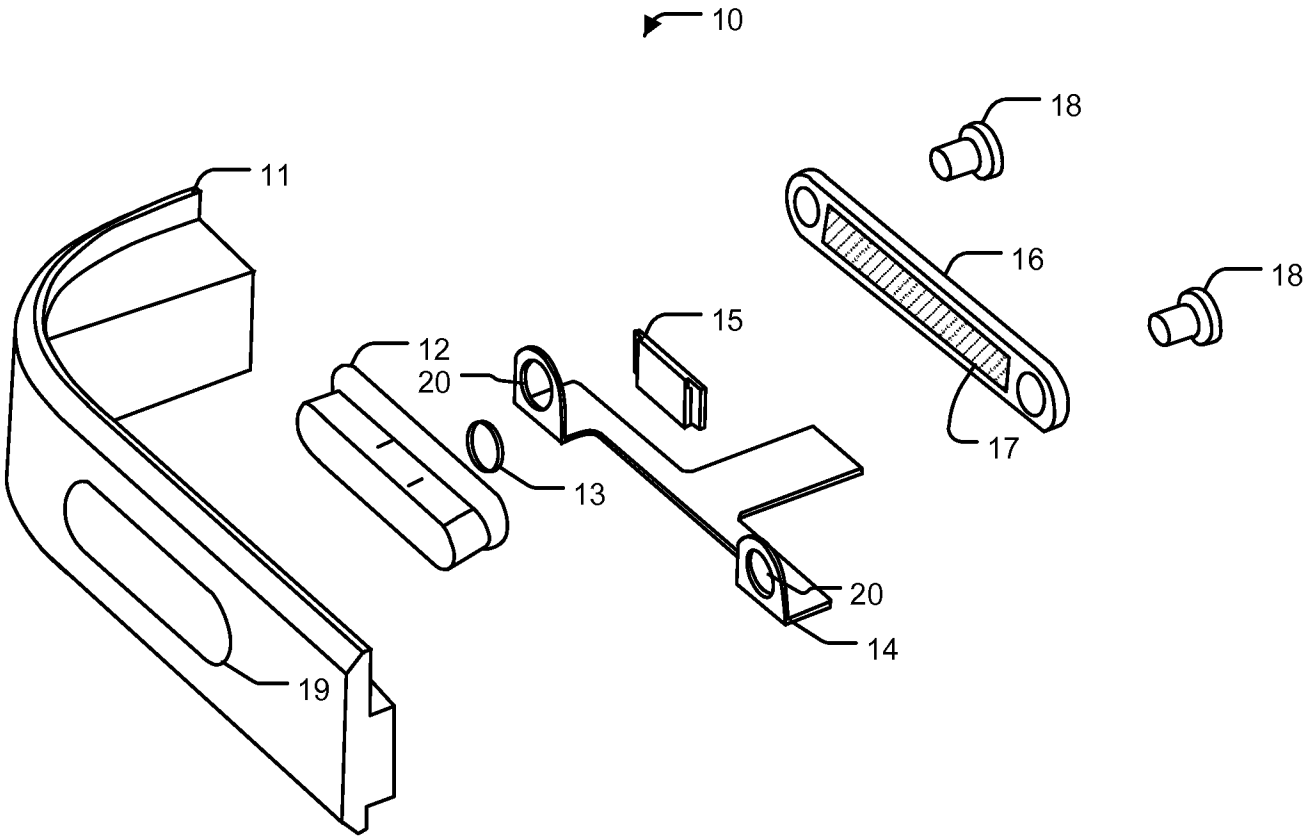
FIG. 1 shows an exploded view of a switch assembly comprising a modular molded interconnect device, according to an embodiment of the present invention.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

An interconnect device is an apparatus configured to allow connectivity between electrical devices or portions of a circuit. A molded interconnect device (MID) is an injection-molded thermoplastic part with integrated electronic circuit traces to allow for this connectivity. Generally, thermoplastics may be used to cast and mold a plurality of MIDs for use in the manufacture of a plurality of different end-user devices.

According to some exemplary embodiments of the present invention, a MID may include a Laser Direct Structuring (LDS) MID. A LDS MID may include a thermoplastic material doped with a metal-plastic additive activated by means of laser or coherent light. A LDS MID may be injection molded such that a plurality of similar devices may be produced with repeatable quality and function. Upon molding, or at any desired subsequent time, a laser writes or traces a desired course for an electronic circuit traces on a surface of the LDS MID. The desired circuit traces may be any suitable circuit traces traceable upon a surface of the LDS MID.

The surface of the LDS MID reacts to the incident laser light such that the metal-plastic additive described above forms a surface texture or "roughness" which exposes or activates metallic portions of the additive. These metallic portions form nuclei for subsequent metallization of the traced circuit path.

For example, in subsequent device processing, the LDS MID may be exposed to a copper bath. This exposure allows for a first layer of conductor to adhere to the formed nuclei on the surface of the LDS MID. Successively layers of copper, nickel, gold, or other suitable conductors may subsequently be adhered to the first layer such that a durable electronic surface trace is formed.

The LDS process may be characterized by other, suitable processing steps either omitted or added to those process steps described above. For example, although generally molded, any modular molded interconnect structure described herein may also include embedded fibers, metal structures, or any other supportive features to adjust or increase rigidity. Therefore, exemplary embodiments should not be limited to any particular form of laser tracing or conductive plating, but rather should be construed to encompass all equivalent acts, structures, and/or materials according to any desired implementation of the present invention.

Hereinafter, embodiments of the invention are described in detail with reference to the Figures, which present various embodiments of switch assemblies incorporating and comprising modular molded interconnect devices and methods of forming the same.

FIG. 1 shows an exploded view of a switch assembly comprising a modular molded interconnect device, according to an embodiment of the present invention. As illustrated, the switch assembly 10 may include a housing or portion of a housing 11. The housing 11 may, according to one embodiment, be a housing for a portable electronic device. The housing 11 may be formed of any suitable material, including aluminum, aluminum alloy, stainless steel, titanium, plastic, thermoplastic, glass, or any other material. According to one embodiment of the invention, the housing 11 is formed from a single block of material defined by a milling process. Although depicted as a corner, it should be understood that the housing 11 may include one or more panels, bosses, through holes, attachment holes, ridges, edges, or any other suitable component not illustrated here for the sake of clarity. Furthermore, the housing 11 may define at least one inner cavity for arranging and supporting a plurality of electronic components, for example, for assembling a personal electronic device.

The housing 11 may include an opening or through-hole 19 arranged therethrough. The opening 19 may be a substantially rectangular opening with chamfered, rounded, or graded corners configured to receive and engage a cosmetic button or button cover. The opening 19 may be a milled opening in a direction generally orthogonal to a major plane X'-Z' defined by the housing 11 (noted in FIG. 3). As such, the opening 19 generally restricts movement of cosmetic buttons engaged therewith along a single major axis, for example, Z'.

The assembly 10 further includes a cosmetic button cover 12 arranged to be received and engaged with the housing 11 at opening 19. The cosmetic button cover 12 may be formed of any suitable material, including the same or similar material as the housing 11. Alternatively, or in combination, the cosmetic button cover 12 may be formed of a different material than that of the housing but include a surface treatment or have a treated surface which renders a surface of the cosmetic button cover 12 to appear the same or similar to the housing 11.

The assembly 10 further includes a shim or spacer 13 arranged to be received and engaged with an inner or bottom portion of the cosmetic button cover 12. The shim 13 may be a simple metal shim, plastic shim, adhesive strip, or any combination thereof. For example, the shim 13 may be a relatively slim piece of rigid material with adhesive applied on at least one outer surface to allow adhesion or attachment to the cosmetic button cover 12. According to other embodiments, the shim 13 may be a piece of adhesive tape or compliant material.

The assembly 10 further includes flexible printed circuit board (PCB) 14. The flexible PCB 14 may be termed a "flex PCB" or any other suitable alternative herein. The flex PCB 14 may be formed of a relatively flexible material allowing for integration of printed/embedded conductive electronic circuit paths thereon and/or therein. The flex PCB 14 may include at least two through holes 20 arranged therethrough. The at least two through holes 20 may be dimensioned to be aligned with complementary fastener receiving holes arranged on or in the housing 11. The flex PCB 14 may include one or more circuit paths or interconnects arranged therein somewhat similar to conventional rigid circuit boards.

The assembly 10 may further include a pushbutton or switching device 15 arranged to engage with shim 13 and cosmetic button cover 12. The pushbutton 15 may be a momentary button biased to be separated from a base substrate 17 (described below). The pushbutton 15 may be formed of a pliable or elastomeric material allowing for depression of the pushbutton 15 against the base substrate 17. The pushbutton 15 may include a conductive segment or segments arranged therein, that, when depressed against the base substrate 17, allows for electrical conduction across at least a portion of the base substrate 17. Alternatively, the pushbutton 15 may include two or more fixed or relatively fixed contact pads arranged to be adhered to the base substrate 17, for example, through application of solder or conductive adhesive. The pushbutton 15 may be configured to selectively switch a conductive path between the two or more contact pads in response to depressing the pushbutton 15.

The assembly 10 further includes modular molded interconnect bracket 16. The modular molded interconnect bracket 16 may be a modular molded interconnect device as described above, and therefore may also be referred to as a LDS MID, LDS bracket, or any similar term. The modular molded interconnect bracket 16 may include the base substrate 17 arranged thereon. The base substrate 17 may include at least one electronic circuit trace created thereon such that depression of the button 15 against said surface causes an electric current to flow, a voltage to equalize, and/or a signal to transfer through the flex PCB 14 which is useable by a portable electronic device or any other suitable device comprising the assembly 10 or a portion thereof. Alternatively, the base substrate 17 may include at least one electronic circuit trace created thereon in communication with two or more contact pads of the button 15 such that operation of the pushbutton 15 causes an electric current to flow, a voltage to equalize, and/or a signal to transfer through the flex PCB 14 which is useable by a portable electronic device or any other suitable device comprising the assembly 10 or a portion thereof.

The assembly 10 further includes fasteners 18 configured to fasten the entire assembly 10 to the housing 11 such that the cosmetic button cover 12 is received and engaged by the housing, the shim 13 is engaged with the cosmetic button cover 12, the flex PCB 14 is arranged against the housing 11, the pushbutton 15 is engaged with the shim 13, and the modular molded interconnect bracket 16 is engaged with the pushbutton 15 and the flex PCB 14. In this manner, the elastomeric biasing force provided by the pushbutton 15 biases the cosmetic button cover 12 such that at least a portion of the cosmetic button cover 12 is accessible through the housing 11, and such access causes the flex PCB 14 to engage the base substrate 17 and cause a signal, current, or voltage readable or accessible through the flex PCB 14 responsive to operation of the pushbutton 15.

Figure 2:
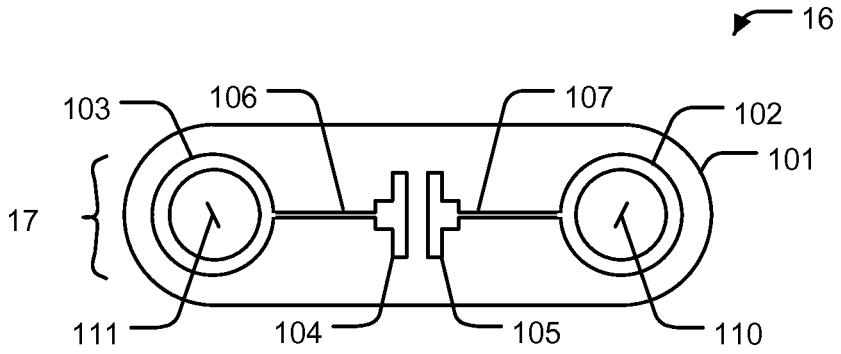
FIG. 2 illustrates a top-planar view of a modular molded interconnect device, according to an embodiment of the present invention.
Figure 3:
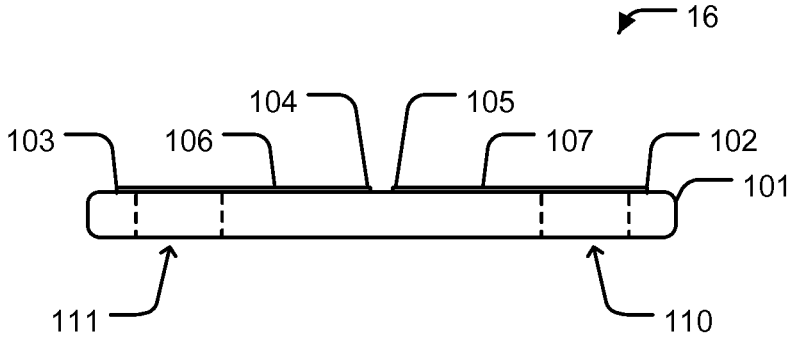
FIG. 3 illustrates a side planar view of a modular molded interconnect device, according to an embodiment of the present invention.

Turning now to FIGS. 2-3, a more detailed discussion of the base substrate 17 and bracket 16 is provided.

FIGS. 2-3 illustrate a top-planar view and a side planar view of the modular molded interconnect bracket 16, according to an embodiment of the present invention. As shown, the bracket 16 includes the base substrate 17 arranged on outer surface 101. The substrate 17 includes circuit traces 102, 103, 104, 105, 106, and 107. Circuit traces 102, 103, 104, 105, 106, and 107 may be formed through a Laser Direct Structuring process as described herein, and may be formed of any suitable conductor, including copper or aluminum. Circuit traces 102 and 103 are arranged as annular traces about through holes 110, 111 which penetrate the bracket 16 to allow fastening with fasteners 18. Circuit traces 102 and 103 are configured to couple with complementary annular or at least partially annular circuit traces or conductive paths exposed on the flex PCB 14. Circuit traces 104 and 105 (e.g., contact pads) are arranged to contact a complementary circuit trace or external pad arranged on a surface of pushbutton 15. Circuit traces 106 and 107 are coupled between traces 103, 104 and 102, 105, respectively, and therefore allow communication between portions of the flex PCB 14 upon appropriate applied force of the pushbutton 15 when arranged as illustrated in FIGS. 4-5.

The entire bracket 16 may be formed of plastic, thermoplastic, or any other suitable material. The bracket 16 may also be a laminated molded bracket formed with a plurality of material layers. The bracket 16 may also be impregnated with fibers, metal structures, or other enforcements to increase strength of the bracket 16.

Figure 4:
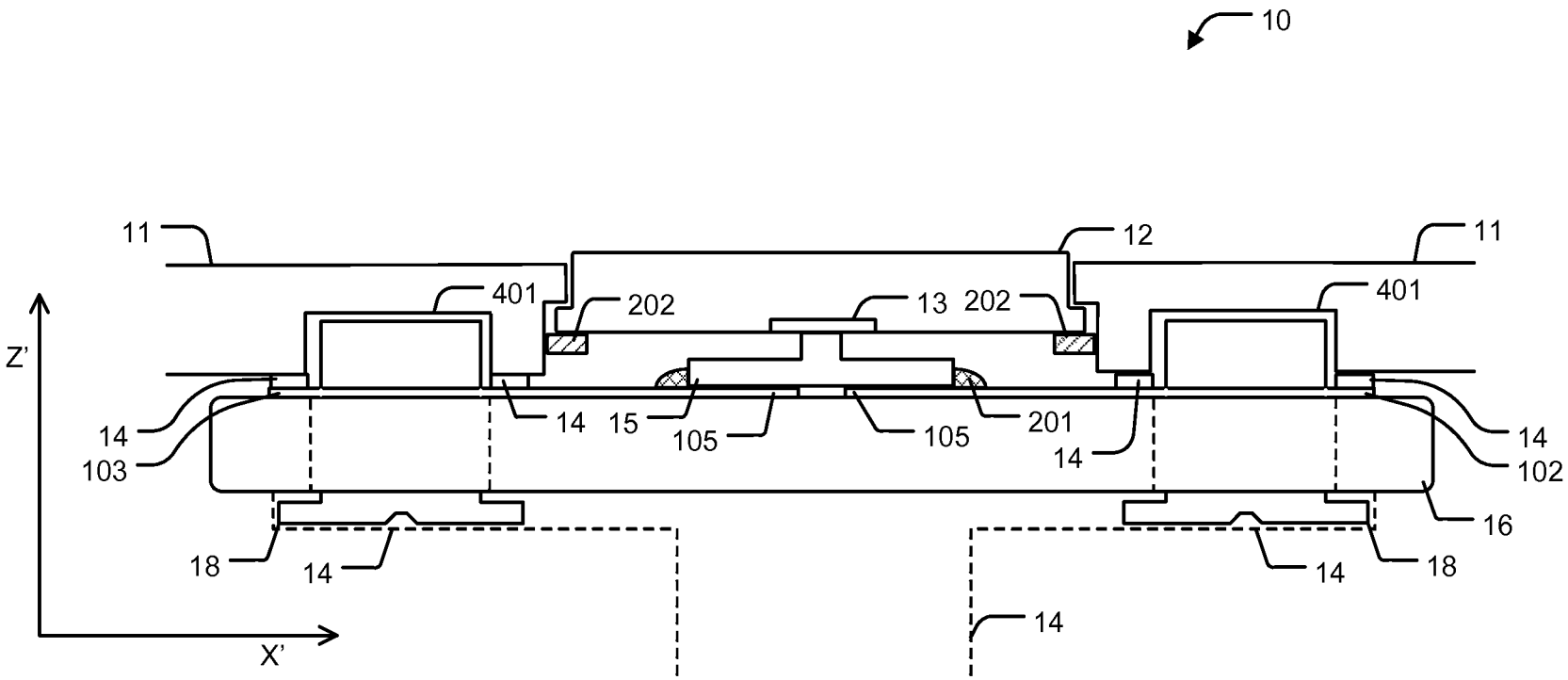
FIG. 4 illustrates a two-dimensional planar slice of the assembled switch assembly of FIG. 1.
Figure 5:
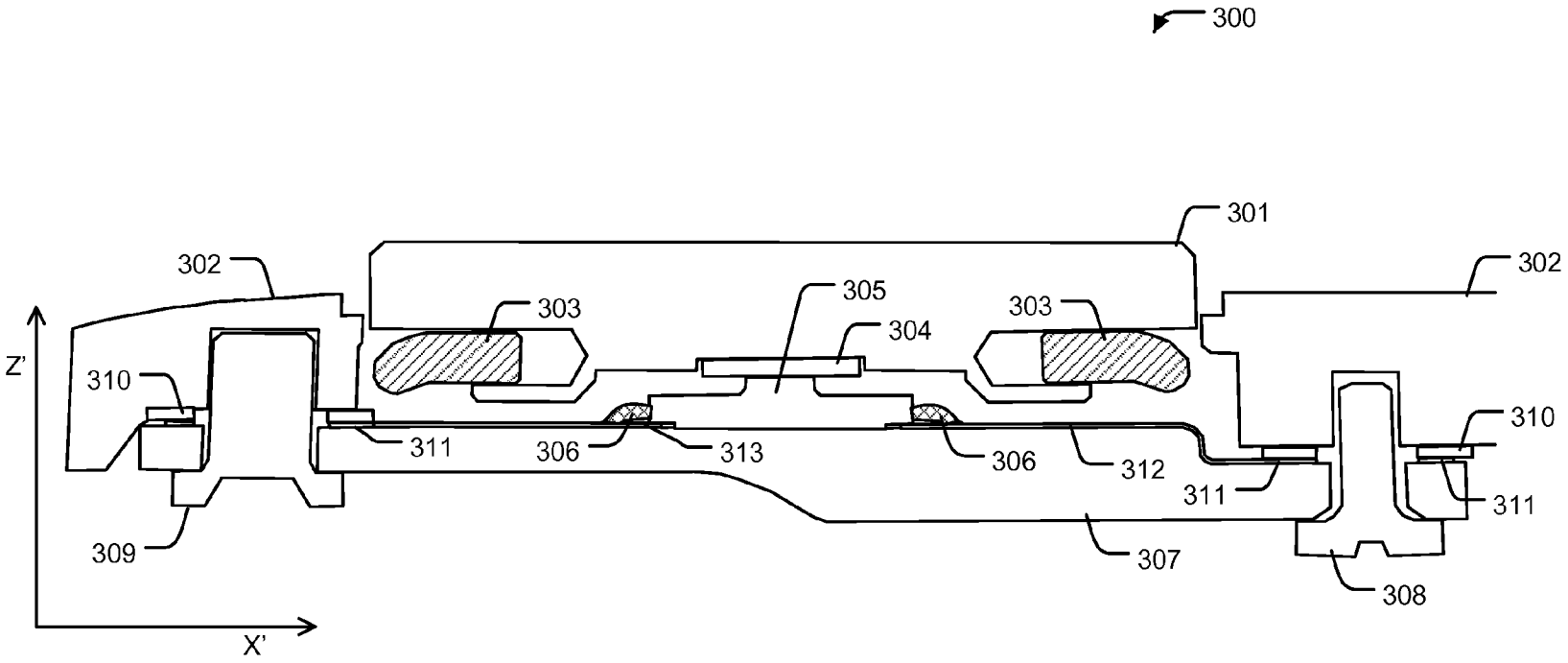
FIG. 5 illustrates a two-dimensional planar slice of an alternate assembled switch assembly comprising a modular molded interconnect device, according to an embodiment of the present invention.

FIG. 4 illustrates a two-dimensional planar slice of the assembled switch assembly of FIG. 1. As shown, the assembly 10 may be assembled and fastened using fasteners 18 engaged with holes 401 which are complementary and aligned with associated through holes of the flex PCB 14 and the bracket 16. Furthermore, appropriate peripheral portions of the pushbutton 15 may be soldered to the conductive traces 105 of the bracket 16 with solder or conductive adhesive 201 to form a switching subassembly. Alternatively, the structural support provided by the fasteners 18 may keep the pushbutton 15 in appropriate alignment. As further shown, elastomeric members 202 may elastically couple the cosmetic button cover 12 to the housing 11. The elastomeric members 202 may be a single elastomeric member arranged about a periphery of the cosmetic button cover 12, or may include two or more elastomeric segments.

It should be understood that as the pushbutton 15 and bracket 16 are easily separable from the assembly 10 as illustrated in FIG. 1 and FIG. 4, both components are easily replaceable either during initial product assembly processes or during a repair/rework cycle. Therefore, it is appreciated that there is a reduced risk of damaging other components in the switch assembly 10 and also other components of any end-user device when utilizing the module bracketing techniques described and illustrated herein. As such, cost for repairing or replacing a defective or malfunctioning button 15 or bracket 16 are reduced as compared to conventional techniques.

Although described and illustrated with basic functionality, it should be understood that the embodiments above may be varied in many ways. For example, FIG. 5 illustrates a two-dimensional planar slice of an alternate assembled switch assembly 300 comprising a modular molded interconnect device, according to another embodiment of the present invention.

As shown, the assembly 300 is functionally similar to the assembly 10, but includes varied componentry to adjust the look and feel of the basic switch assembly 10. For example, the housing 302 may be beveled and machined to enhance durability, look, and feel. Furthermore, the cosmetic button cover 301 is also shaped, machined, and beveled. Furthermore, elastomeric members 303 are enhanced and coupled beneath the button cover 301 to alter touch and physical feedback characteristics of the shim 304 and button 305. Furthermore, the bracket 307 includes an altered side profile which may enhance the usage of space in a portable electronic device. Similarly, the profiles of conductive trances 311, 313, and 312 are altered to match the new profile of the bracket 307. Solder 306 may also be used to couple the button 305 to bracket 307, or may be omitted. Fasteners 308 and 309 are of differing profiles to match the change in profile of the bracket 307. Finally, flex PCB 310 is also altered to match the profile of bracket 307.

As described above, switch assemblies implementing modular molded interconnect devices may be used in a plurality of devices, and may include a modular molded interconnect bracket having at least one electronic circuit trace arranged thereon configured to interconnect a portion of a flexible printed circuit board, and a switch arranged to contact portions of the at least one electronic circuit trace coupled to the modular molded interconnect bracket.

Hereinafter, methods of forming modular molded interconnect devices, switching subassemblies, and switching assemblies for use in electronic devices are described in detail with reference to FIGS. 6-7.

Figure 6:
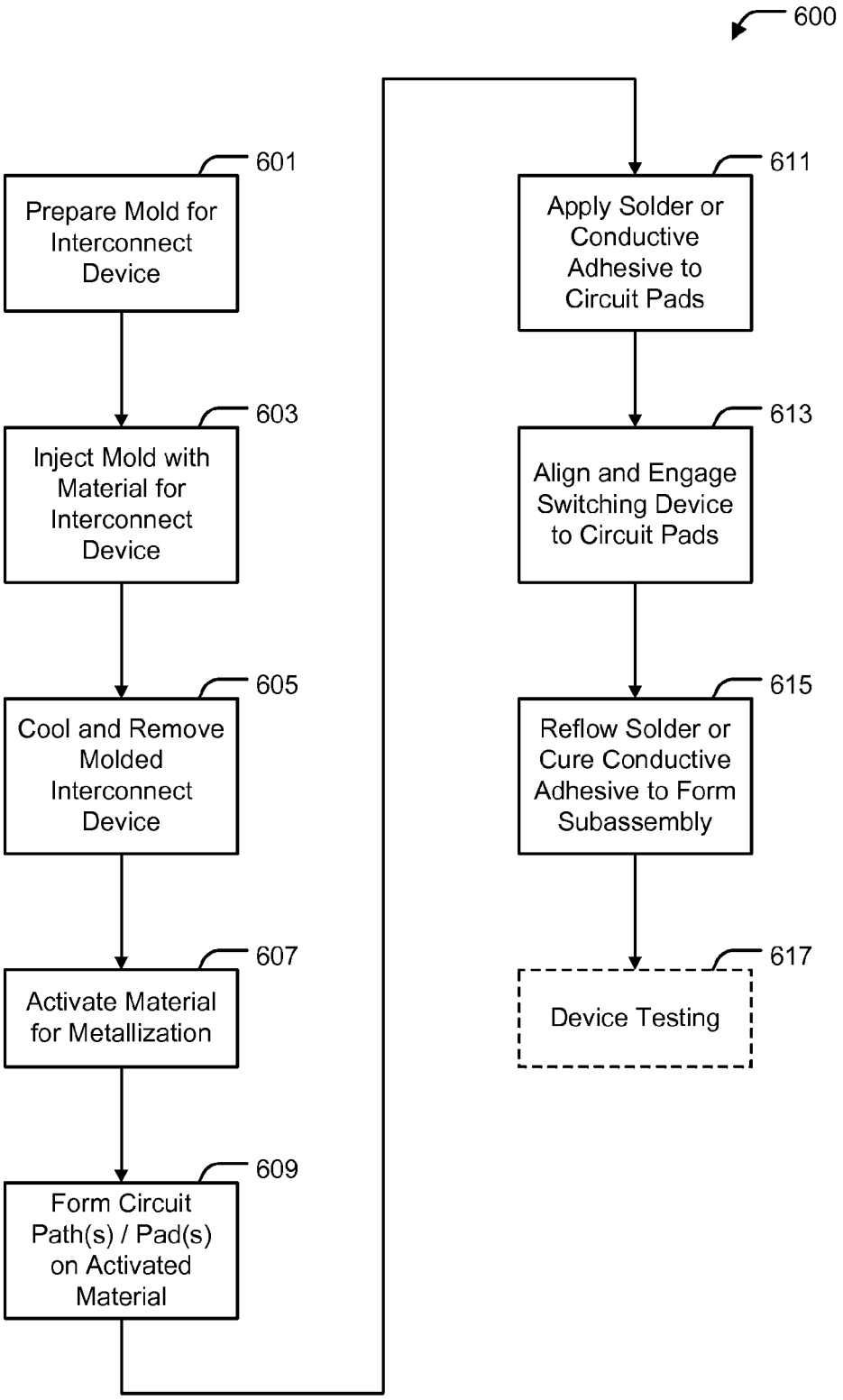
FIG. 6 illustrates a flow chart of a method of forming a modular molded interconnect device, according to an embodiment of the invention.

Turning to FIG. 6, a flowchart of the method 600 of forming a modular molded interconnect device is illustrated, according to an embodiment of the invention. The method 600 may include preparing a mold configured to form an interconnect device at block 601. Preparing the mold may include any suitable cleaning, alignment, preheating, or testing process necessary to prepare the mold to receive material for forming the device.

The method 600 further includes injecting the prepared mold with material to form the interconnect device at block 603. The material may include plastic, thermoplastic, or any other suitable material with at least a fraction thereof comprising a dopant material reactive to forming conductive metal traces or receiving, adhering, and supporting conductive metal traces. The dopant may be a metal-plastic additive. The metal-plastic additive may include any suitable additive including minerals, metal alloys, or other materials for laser direct structuring processes.

The method 600 further includes cooling and/or removing the molded interconnect device from the mold at block 605.

The method 600 further includes activating the dopant material for a subsequent metallization process at block 607. The activating may include exposing portions of surfaces of the molded interconnect device to laser light.

The method 600 further includes forming circuit paths and/or pads on the activated dopant material 609. For example, suitable circuit paths may be somewhat similar to those illustrated in FIG. 2.

The method 600 further includes forming a switching subassembly at blocks 611, 613, and 615, and device testing of the subassembly at block 617.

For example, forming the subassembly may include applying solder or conductive adhesive to the formed contact paths or circuit paths at block 611, aligning and engaging a switching device (e.g., pushbutton 15) to the pads at block 613, and reflowing the solder or curing the adhesive to form the subassembly at block 615.

The formed subassembly may be used in a switching assembly, such as assembly 10.

Figure 7:
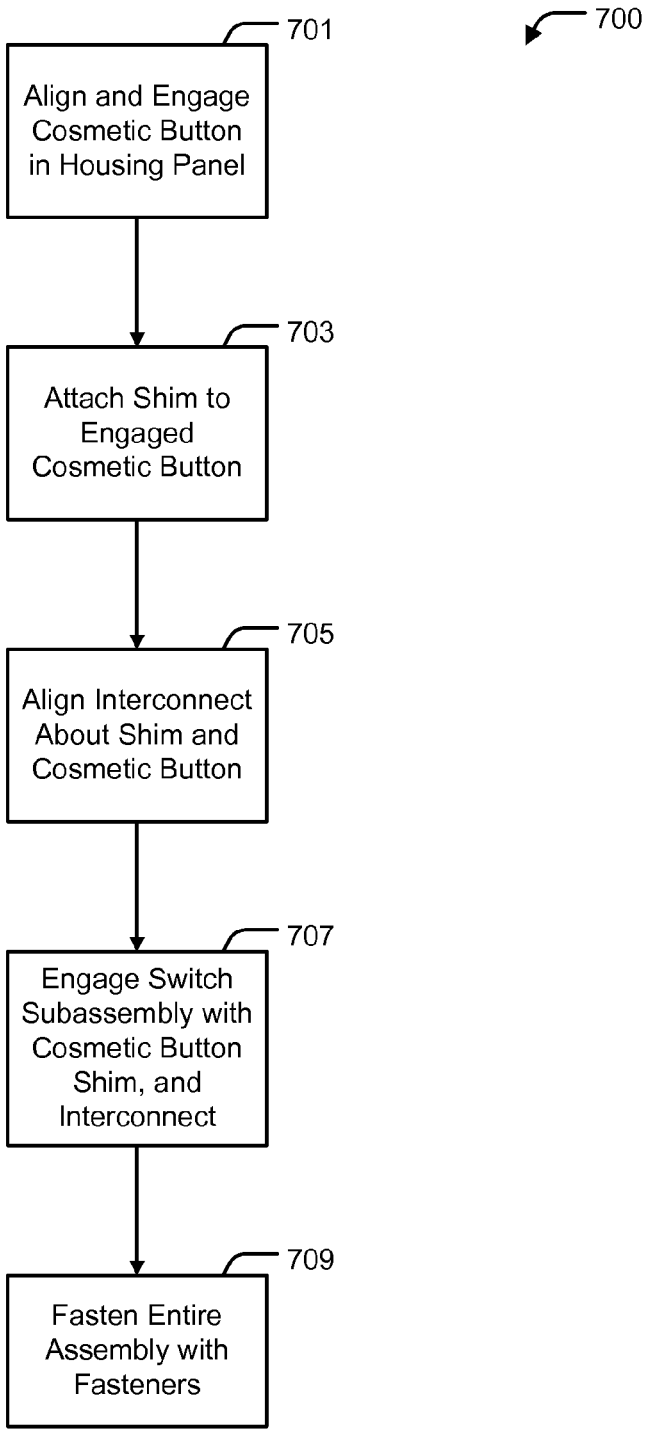
FIG. 7 illustrates a flow chart of a method of assembling a switch assembly, according to an embodiment of the invention.

FIG. 7 illustrates a flow chart of a method 700 of assembling a switch assembly, according to an embodiment of the invention. The method 700 includes aligning and engaging a cosmetic button or button cover in a recess of a housing panel at block 701. For example cosmetic button 12 may be aligned an engaged with hole 19 of housing 11.

The method 700 further includes attaching a shim or compliance member to the engaged cosmetic button at block 703. For example, shim 13 may be engaged with or attached to the cosmetic button 12.

The method 700 further includes aligning a flex PCB or interconnects about the shim and cosmetic button at block 705. For example, holes 20 of flex PCB 14 may be aligned with complementary holes 401 of the housing 11.

The method 700 further includes engaging a switching subassembly with the cosmetic button, shim, and interconnect at block 707. For example, through holes of the modular molded interconnect device may be aligned with complementary through holes of the flex PCB 14 and holes 401.

Thereafter, the method 700 includes fastening the entire assembly with fasteners at block 709. The fastening may include aligning, inserting, engaging, and retaining fasteners 18 with holes 401.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A switching assembly for an electronic device, the switching assembly comprising:

an interconnect bracket that supports a flexible printed circuit board, the interconnect bracket including a first conductive segment and a second conductive segment, the first conductive segment configured to couple with a first electrical circuit portion of the flexible printed circuit board and the second conductive segment configured to couple with a second electrical circuit portion of the flexible printed circuit board;

a switching device arranged on the interconnect bracket and including a conductive bridge arranged to interconnect the first conductive segment and the second conductive segment;

a fastener arranged to support the interconnect bracket against the flexible printed circuit board and the flexible printed circuit board against a housing of the electronic device; and a compliance member engaged with the switching device and a cosmetic button cover, the cosmetic button cover engaged with the housing.

2. The switching assembly of claim 1, wherein the compliance member is comprised of metal, plastic, adhesive, or a combination thereof.

3. The switching assembly of claim 1, wherein the interconnect bracket includes at least one opening configured to accommodate at least one fastener for securing the switching assembly to the housing of the electronic device.

4. The switching assembly of claim 3, wherein the interconnect bracket is configured to secure at least a portion of the flexible printed circuit board to the housing.

5. The switching assembly of claim 3, wherein the flexible printed circuit board is positioned between the interconnect bracket and the housing.

6. The switching assembly of claim 1, wherein the switching device is coupled with the interconnect bracket with solder or conductive adhesive.

7. The switching assembly of claim 1, wherein the interconnect bracket is comprised of thermoplastic impregnated with laser-activated material.

8. The switching assembly of claim 7, wherein the laser-activated material supports at least one layer of conductive material forming the first conductive segment and second conductive segment.

9. The switching assembly of claim 1, wherein the interconnect bracket includes reinforcing fibers or structures molded therein.

10. The switching assembly of claim 1, wherein the interconnect bracket includes an opening to accommodate the fastener.

11. The switching assembly of claim 10, further comprising:

an elastomeric member coupled between the cosmetic button cover and the housing.

12. The switching assembly of claim 10, wherein the housing is formed of aluminum, an aluminum alloy, or stainless steel.

13. The switching assembly of claim 12, wherein the cosmetic button cover is textured or surface treated to have a cosmetic appearance of the aluminum, aluminum alloy, or stainless steel of the housing.

14. A switching assembly for an electronic device, the switching assembly comprising:

a flexible printed circuit board having a first electrical circuit portion and a second electrical circuit portion;

an interconnect bracket supporting the flexible printed circuit board and including a first conductive segment and a second conductive segment, the first conductive segment coupled with the first electrical circuit portion of the flexible printed circuit board and the second conductive segment coupled with the second electrical circuit portion of the flexible printed circuit board;

a switching device including a conductive bridge interconnecting the first conductive segment and the second conductive segment; and a fastener arranged to support the interconnect bracket against the flexible printed circuit board and the flexible printed circuit board against a housing for the electronic device; and a compliance member that is engaged with the switching device and a cosmetic button cover positioned within an opening of the housing.

15. The switching assembly of claim 14, wherein the switching assembly comprises a plurality of fasteners, the plurality of fasteners cooperating to support the interconnect bracket against the flexible printed circuit board and the flexible printed circuit board against the housing.

16. The switching assembly of claim 15, further comprising:

an elastomeric member coupled between the cosmetic button cover and the housing.

17. The switching assembly of claim 15, wherein the housing is formed of aluminum, an aluminum alloy, or stainless steel.

18. The switching assembly of claim 15, wherein:

the interconnect bracket is formed of thermoplastic.

19. The switching assembly of claim 18, wherein:

the thermoplastic is impregnated with laser-activated material.

20. The switching assembly of claim 19, wherein:

the laser-activated material supports at least one layer of conductive material forming the first conductive segment and second conductive segment.

21. A switching assembly for an electronic device, the switching assembly comprising:

an interconnect bracket configured to support a portion of a flexible printed circuit board, the interconnect bracket including a first conductive segment and a second conductive segment, the first conductive segment configured to couple with a first electrical circuit portion of the flexible printed circuit board and the second conductive segment configured to couple with a second electrical circuit portion of the flexible printed circuit board;

a switching device including a conductive bridge that interconnects the first conductive segment and the second conductive segment;

a fastener arranged to support the interconnect bracket against the flexible printed circuit board and the flexible printed circuit board against a housing of the electronic device, wherein the interconnect bracket includes an opening arranged to accommodate the fastener; and a compliance member engaged with the switching device and with a cosmetic button cover, the cosmetic button cover having a surface corresponding to an exterior surface of the electronic device.

* * * * *